US007866368B2

(12) United States Patent
Ostrovsky et al.

(10) Patent No.: US 7,866,368 B2
(45) Date of Patent: Jan. 11, 2011

(54) GARAGE DOOR PANEL CONSTRUCTION AND HARDWARE

(75) Inventors: Leonard Ostrovsky, Thornhill (CA); Raymond J. Friesen, Mississauga (CA)

(73) Assignee: Raynor Garage Doors, Dixon, IL (US)

( * ) Notice: Subject to any disclaimer, the term of this patent is extended or adjusted under 35 U.S.C. 154(b) by 638 days.

(21) Appl. No.: 11/371,548

(22) Filed: Mar. 9, 2006

(65) Prior Publication Data

US 2006/0201639 A1 Sep. 14, 2006

Related U.S. Application Data

(60) Provisional application No. 60/661,289, filed on Mar. 11, 2005.

(51) Int. Cl.
*E05D 15/06* (2006.01)

(52) U.S. Cl. ..... 160/201; 160/229.1

(58) Field of Classification Search ..... 160/201, 160/229.1, 235, 232, 40
See application file for complete search history.

(56) References Cited

U.S. PATENT DOCUMENTS

| | | | | | |
|---|---|---|---|---|---|
| 2,525,309 | A | * | 10/1950 | Norberg | 16/97 |
| 3,376,913 | A | * | 4/1968 | Clapsaddle | 160/201 |
| 3,608,613 | A | * | 9/1971 | Halliwell | 160/229.1 |
| 3,941,180 | A | | 3/1976 | Thill | |
| 3,967,761 | A | | 7/1976 | Melton, Jr. et al. | |
| 4,156,448 | A | * | 5/1979 | Bengtsson | 160/232 |
| 4,284,119 | A | * | 8/1981 | Martin et al. | 160/232 |
| 4,644,725 | A | | 2/1987 | Schijf | |
| 4,893,666 | A | * | 1/1990 | Hormann | 160/229.1 |
| 4,934,439 | A | * | 6/1990 | Martin | 160/201 |
| 5,002,114 | A | * | 3/1991 | Hormann | 160/229.1 |
| 5,129,441 | A | | 7/1992 | Leist et al. | |
| 5,148,850 | A | | 9/1992 | Urbanick | |
| 5,170,832 | A | * | 12/1992 | Wagner | 160/201 |
| 5,188,163 | A | * | 2/1993 | Schwartzengraber et al. | 160/229.1 |
| 5,235,724 | A | * | 8/1993 | Perrin et al. | 16/97 |
| 5,359,812 | A | | 11/1994 | Mayfield | |
| 5,782,283 | A | * | 7/1998 | Kendall | 160/229.1 |
| 6,041,478 | A | * | 3/2000 | Martin | 16/385 |
| 6,082,429 | A | * | 7/2000 | Ochoa | 160/201 |
| 6,250,361 | B1 | * | 6/2001 | Ochoa | 160/201 |
| 6,330,901 | B1 | * | 12/2001 | Friesen et al. | 160/201 |
| 6,408,926 | B1 | * | 6/2002 | Hoofard et al. | 160/236 |
| 6,527,036 | B1 | * | 3/2003 | Welsh | 160/201 |
| 6,578,619 | B2 | * | 6/2003 | Wright | 160/229.1 |
| 6,629,387 | B2 | * | 10/2003 | Whitley et al. | 52/64 |
| 6,772,818 | B2 | * | 8/2004 | Whitley et al. | 160/236 |

* cited by examiner

*Primary Examiner*—David Purol
(74) *Attorney, Agent, or Firm*—Banner & Witcoff, Ltd

(57) ABSTRACT

Adjacent panels of a folding door included opposed edges having a tongue and groove, pinch proof construction. The panels are formed of spaced sheet metal sections with an insulating form between the sections. The panels are hinged along their opposed side edges by hinges with attachable bracket and brace members for support of edge mounted rollers and reinforcing cross braces.

9 Claims, 11 Drawing Sheets

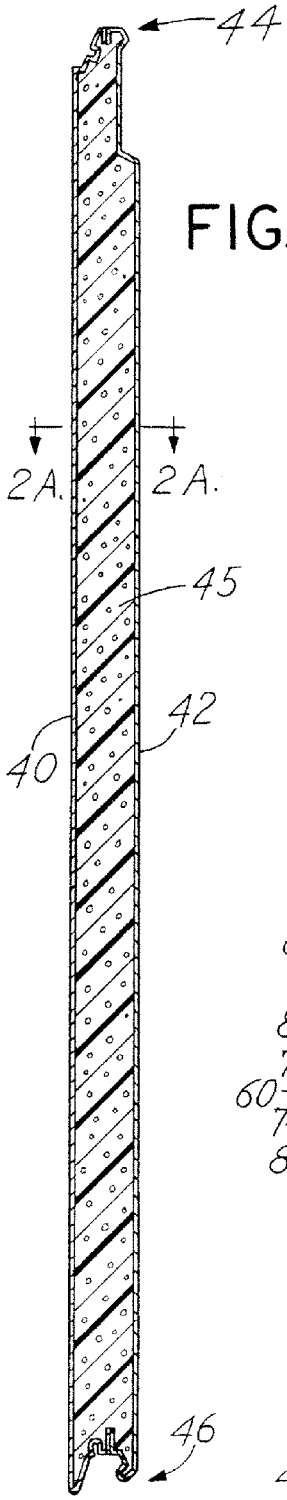
FIG.2
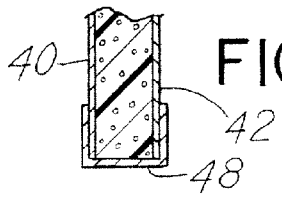
FIG.2A
FIG.3
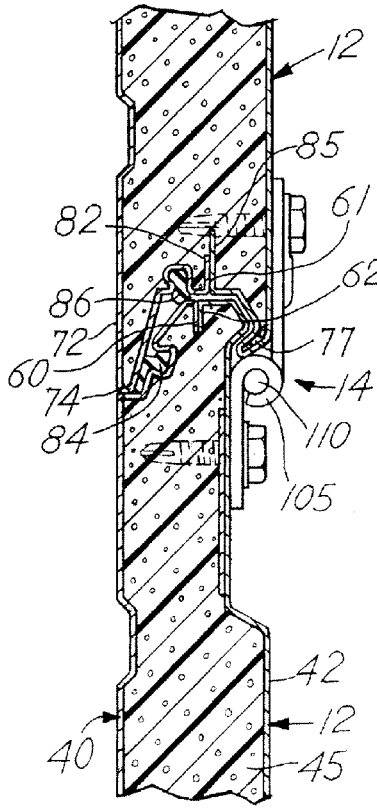
FIG.4
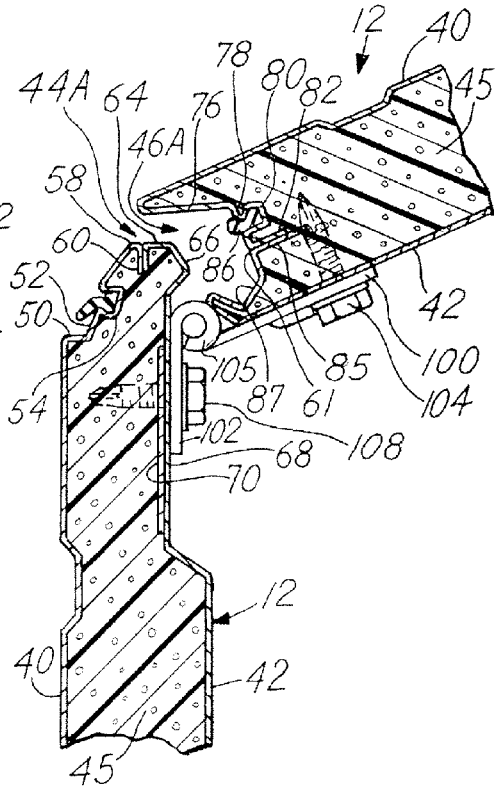

FIG.11
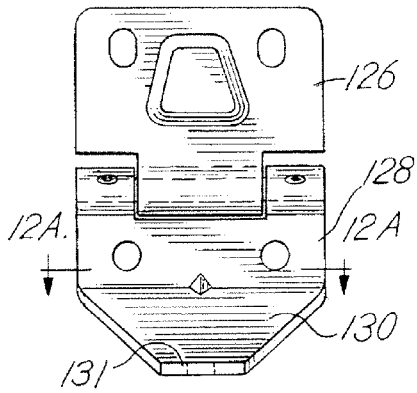
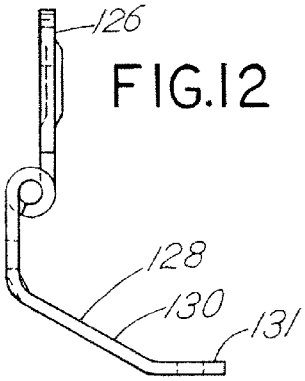
FIG.12
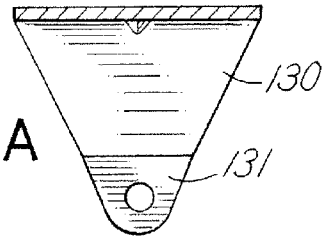
FIG.12A
FIG.14
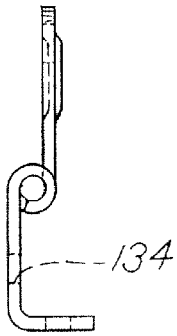
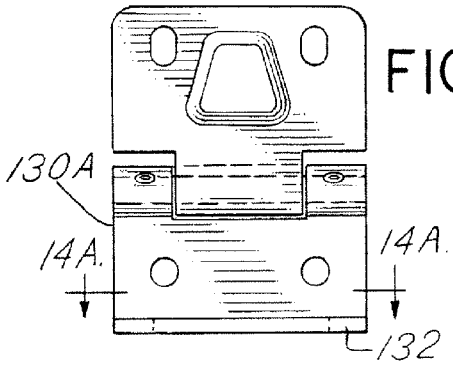
FIG.13
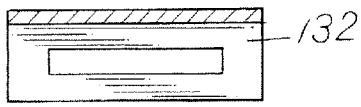
FIG.14A

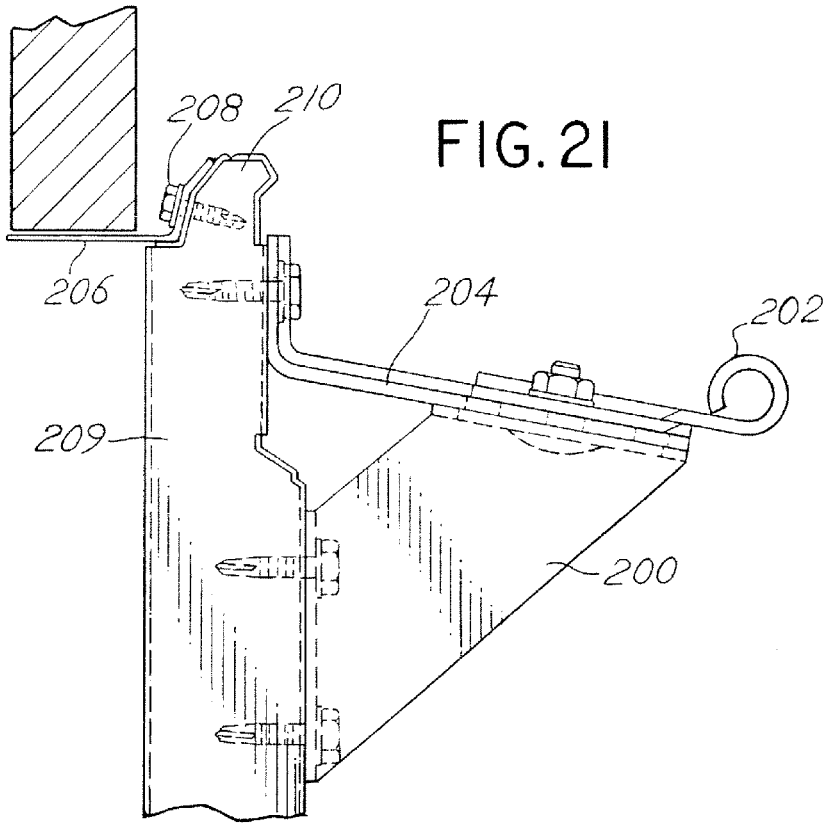
FIG. 21
FIG.22
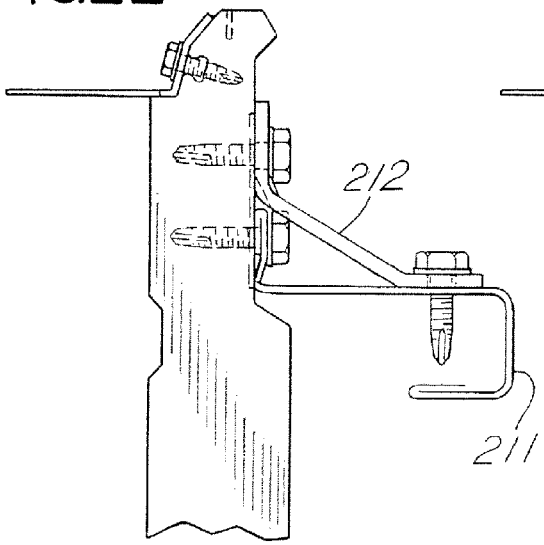
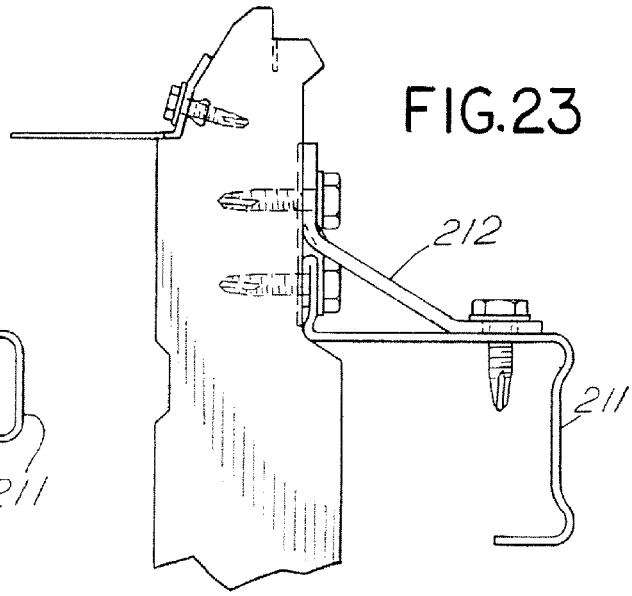
FIG.23

GARAGE DOOR PANEL CONSTRUCTION AND HARDWARE

CROSS REFERENCE TO RELATED APPLICATION

This is a utility application which claims priority to and incorporates by reference previously filed provisional application Ser. No. 60/661,289 filed Mar. 11, 2005 entitled "Garage Door Panel Construction and Hardware.

BACKGROUND OF THE INVENTION

In a principal aspect the present invention relates to the construction of garage door panels, and, more particularly, to the construction of a pinch proof edge construction for garage door panels that are connected in a manner which enables them to articulate as the move along a curved mounting track between a closed condition and an open condition. Further, the present invention relates to the mounting hardware associated with such door panels, particularly insulated door panels formed of opposed sheets of metal with an insulating foam therebetween.

Sectional door panels are commonly used in various commercial, industrial and residential applications, particularly for sectioned garage doors wherein a series of adjacent panels are connected to one another along horizontal axis, hinge joints. The panels are typically mounted on rollers that fit in tracks to guide movement of the panels between a closed and an open condition. Examples of such sectional doors are described in various U.S. patents, including the following:

| U.S. PAT. NO. | TITLE |
|---|---|
| 3,941,180 | Sectional Door and Guard Rail Assembly |
| 3,967,761 | System for Injecting Particulate Material into the Combustion Chamber of a Repetitive Combustion Coating Apparatus |
| 4,644,725 | Double-Walled Panel |
| 4,893,666 | Articulated Overhead Gate |
| 5,002,114 | Overhead Door |
| 5,129,441 | Sectional Doors and Compressible Flexible Hinge Assemblies |
| 5,148,850 | Weatherproof Continuous Hinge Connector for Articulated Vehicular Overhead Doors |
| 5,170,832 | Lift Link Gate Having a Plurality of Tabular Gate Elements |
| 5,359,812 | Finger Guard |
| 6,330,901 | Z-Shaped Strut for Door Panel |

Among the features desirable with such door panel constructions are the provision of a joint between the adjacent panels designed to preclude the creation of pinch points as the panels move along a curved track and articulate with respect to one another. Patents which disclose pinch proof for horizontal edges of door panels include the following:

| U.S. PAT. NO. | TITLE |
|---|---|
| 3,967,671 | Upwardly-Acting Sectional Door |
| 3,941,180 | Sectional Door and Guard Rail Assembly |

The noted patents are incorporated herewith by reference as background information. Typically, in a multiple panel or multiple section garage door which has insulating characteristics, the separate panels are made from a formed metal outside sheet and a formed metal inside sheet spaced from the outside sheet. The sheets may be made from embossed metal and may be shaped during the manufacturing process to provide decorative features such as recessed portions of the panels and the like. Typically, the formed metal sheets are arrayed in opposed relation and have a horizontal length substantially equivalent to the width of a garage door, by way of example, and a vertical height in the range of 1-3 feet. The space between the panel sheets is generally filled with an insulating foam material. The panels are then hinged to one another so that they may articulate between a planar array and an articulated array during movement along a mounting and support track to reveal a door opening.

The hardware, to attach the panels to the track and to one another as well as to provide adequate reinforcement of the door panels in order to comply with code and structural requirements, are the subject of numerous prior art patents such as those set forth above. Nonetheless, there has remained the need to provide improved features associated with such panel constructions for use as garage doors and in other sectioned panel door applications. The construction of the horizontal edges of the adjacent panels to provide pinch proof type protection as well as the hardware for mounting the panels on a track are all topics of desired improvement. The present invention relates to such topics.

SUMMARY OF THE INVENTION

Briefly, the present invention comprises a panel construction and hardware for a multi-sectional or multi-panel door construction. Typically, such a door construction is embodied as a garage door construction. However, the invention is not limited to garage door panels or garage door constructions and the invention and various embodiments thereof may be utilized for, and in cooperation with, any ingress and egress opening wherein a multi-section, panel door is mounted on a track, and wherein the door may be maintained in a closed condition with the panels in a generally flat planar configuration or moved to an open position by guiding the panels along the track causing the panels to articulate with respect to each other as they move to the open position.

The invention relates, in particular, to panel constructions wherein the top and bottom, typically horizontal, lateral edges of the panels are formed from a front or outside panel member and a back or inside panel member. The panel members are opposed and spaced from one another with the space therebetween typically filled with insulating foam material. The horizontal edges of the panels are configured so as to be "pinch proof". Thus, the edges employ a tongue and groove construction and include various sealing members or means to facilitate the insulating qualities of the door construction. The invention is further characterized by utilization of hinges which connect adjacent panels and facilitate the incorporation of a truss and brace system for the door construction. Various auxiliary brace components are disclosed which are universal in character. That is, the brace components and hinges may be utilized in association with rollers at the sides or the generally vertical side edges of the door panels. Components are also disclosed which connect the door panels at locations other than the side edges. The hinges, truss elements and braces are characterized by their capability to be adjusted relative to their position on the door panels and with respect to the panel mounting track.

Thus, it is an object of the invention to provide improved, multi-sectioned or multi-panel door construction of the type comprised of panels having an outside panel member and an inside panel member formed or shaped to define a space therebetween which may include foam insulation material.

It is a further object of the invention to provide a door panel construction which includes generally horizontal edge configurations having a tongue and groove design employing a pinch proof construction;

A further object of the invention is to provide door panel hinge members which may be incorporated with truss and brace members wherein the hinge members maybe used at numerous locations to connect and permit articulation of door panels with respect to one another and wherein the hinge members may be easily combined with truss and brace members thereby reducing the number of parts and their complexity for the construction of a multi-panel door.

A further object of the invention is to provide a rugged, easy to assemble yet inexpensive and easily repaired door panel construction comprised of multiple panels.

Another object of the invention is to provide a door panel construction which includes features enabling incorporation of various truss and brace members to reinforce a multiple panel door.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 2 is a side view of a door panel incorporating aspects of the invention wherein the door panel is comprised of an outside panel member joined to an inside panel member along an adhesive joint and wherein the panel members are separated one from the other with the space therebetween filled by an insulating foam material;

FIG. 2A is a cross-sectional view of FIG. 2 as viewed along section 2A-2A;

FIG. 3 is a side, cross sectional view of a first door panel and a second door panel depicted edge to edge wherein the door panels have a reduced dimension between the outside panel member and the inside panel member, and the panels are arrayed in a flat planar condition;

FIG. 4 is a side, cross sectional view of the panels of FIG. 3 in an articulated condition;

FIGS. 7-12, 12A, 13, 14 and 14A comprise various views illustrating various hinge components used in the practice of the invention;

FIGS. 21-23 are side views that illustrate additional truss brackets and roller brackets particularly as associated with the top edge of a door panel in an array of door panels;

DESCRIPTION OF THE PREFERRED EMBODIMENT

Figure 1:
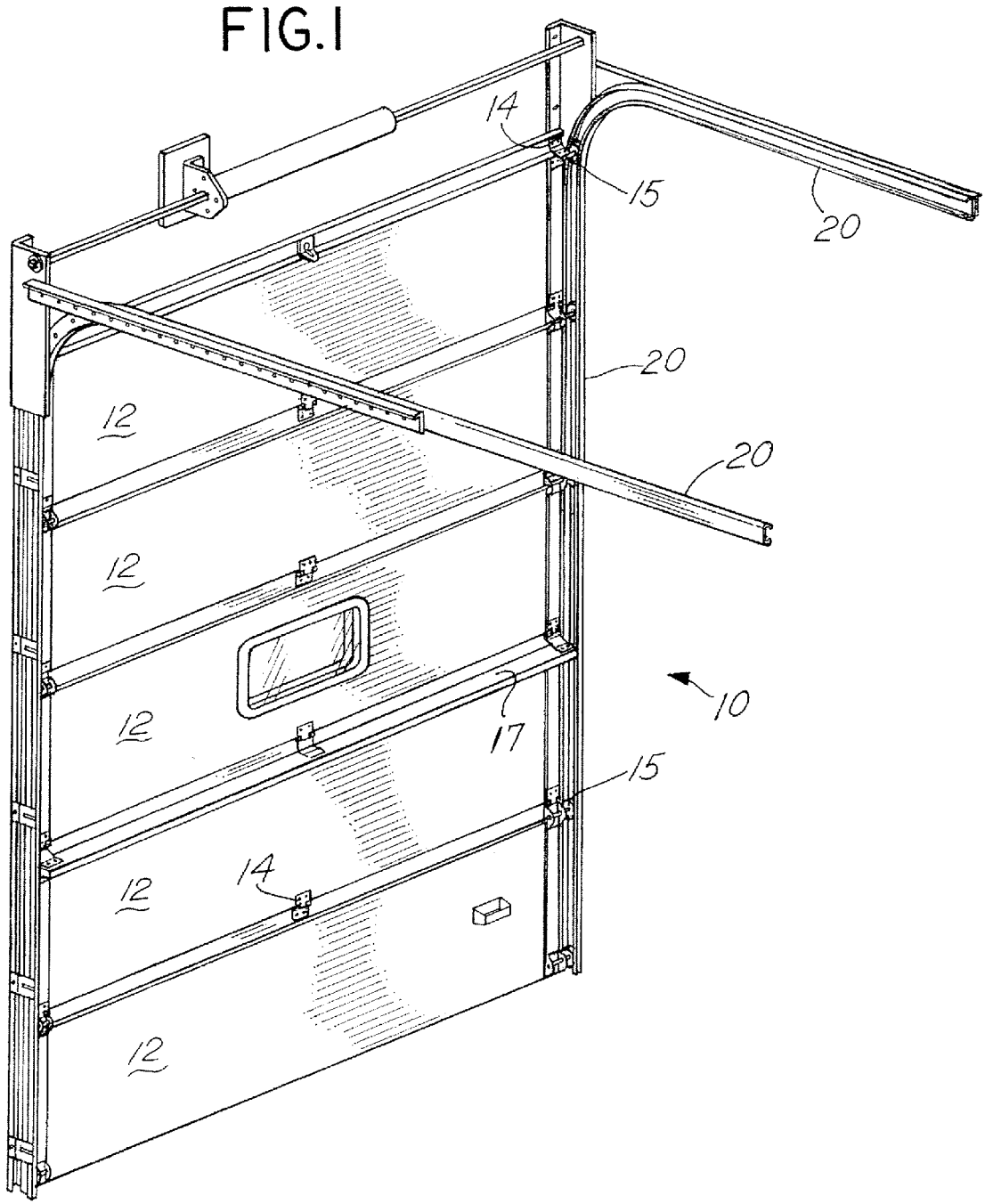
FIG. 1 is a an isometric view of the interior side of an array of door panels in combination mounted at an opening for movement along a track.

Referring to FIG. 1, there is depicted the general array and arrangement of a group of door panels of a type generally utilized in the practice of the invention as assembled, manufactured and incorporated for access to a garage door opening. The embodiments of the invention are thus described with respect to a roller door having multiple sections or panels which is commonly used in garages. However, the door constructions may be used in any type of ingress and egress application whether in a small opening or a large opening. Thus, the following description of door panel constructions is not limited to any particular opening or application.

Referring to FIG. 1, the door construction 10 comprises a number of individual panels 12. The panels 12 are typically formed from sheet metal and may include decorative embossings or imprintings particularly on the outer side. As depicted in FIG. 2, each panel is fabricated from an outside panel member 42 and a spaced inside panel member 40 wherein the panel members 40, 42 may be joined together by an adhesive material 61 which also, typically, has insulating or non heat transfer characteristics. The region between the panels 12 typically includes a foam insulation material 45. The panels 12 are connected to one another by hinges 14. The hinges 14 at the edges of the panels 12 or the lateral sides of the panels 12, are cooperative with the rollers 15. The hinges 14 intermediate the edges or sides of the panels 12 may cooperate with cross members or trusses 17.

The rollers 15 associated with the hinges 14 or otherwise mounted at the edges of the panels 12 are mounted in tracks 20 which receive and capture the rollers 15 and guide the movement of the rollers 15 and thus the panels 12 as the doors are raised or transported from one position to another. Typically, the panels 12 define a flat planar array when closed and then articulate with respect to each other as they are raised or opened. The door may be raised by any number of known door raising mechanisms or may be done so manually. As a door is raised the rollers 15 follow the track 20 to a position where the door is stored in the track 20 and lifted out of the door opening.

It is to be noted that as the width of the door increases the sectional panels 12 may require a reinforcement, e.g., truss 17, and may also require additional hinging members 14 to connect the adjacent panels 12. Additionally, various code requirements in various regions of the world may require additional reinforcing struts or trusses 17. The invention contemplates the incorporation of trusses or reinforcing struts as well as various designs of the top and bottom horizontal edges of the door panels 12, the hinge 14 connections, the connections for the rollers 17 and the interrelationship of these various components.

Thus, referring now to FIG. 2, there is depicted a side view of an embodiment of a typical door panel 12 which incorporates aspects of the invention. The door panel 12 includes an outside panel member 40 and an inside panel member 42. The outside panel member 40 may be formed as a flat planar outside sheet or it may be embossed or otherwise configured to provide a decorative characteristic. The inside panel member 42 is likewise formed and may include embossing to facilitate strengthening thereof. However, typically the inside panel member 42 is a flat planar panel. The inside panel member 42 and outside panel member 40 are joined together at their horizontal edges 44 and 46. The edge 44 is generally in the form of a tongue and the edge 46 is generally in the form of a groove as described hereinafter, and when opposed they feature pinch proof characteristics. The space between the panel members 40 and 42 is typically filled with an insulating foam material 45. The panels 12 are generally connected to, joined by, and incorporate an end cap or side edge 48 as depicted in FIG. 2A.

Referring next to FIGS. 3 and 4 there is depicted a first embodiment of two adjacent panels 12 having the tongue and groove feature as well as a hinge 14 connection associated with panels 12. The embodiment of FIGS. 3 and 4 employs a reduced dimension between outside panel member 40 and inside panel member 42 as contrasted with the embodiment of FIGS. 5 and 6 wherein the dimension between inside panel member 42 and outside panel member 40 is increased or greater than the embodiment of FIGS. 3 and 4. The difference in the dimension between the panels 40 and 42 may affect, to some extent, the design of the tongue and groove arrangement associated with the respective embodiments.

Referring first, therefore, to the embodiment of FIGS. 3 and 4 the horizontal edge or tongue 44A cooperates with the groove 46A. The tongue 44A includes a first generally horizontal shelf 50 and an upwardly extending and inwardly inclined interior wall 52 with a recess 54 therein for receipt of a seal member 84. The upwardly extending wall 52 connects to a further, generally horizontal section 58 and a downwardly depending flange 60. Insulating adhesive material 61 is provided on the flange 60, and the flange 60 is arrayed in opposed relation to a depending flange 62 associated with the inside panel member 42. The depending flange 62 connects with a horizontal panel wall section 64 which further connects with a depending section 66 having generally an arcuate shape to connect with a vertical length section 68. It should be noted that the inside panel member 42 includes a reinforcing plate 70 which extends across the entire length of the panel member 42 to strengthen the panel 12 and, more particularly, to strengthen the region of the panel member 42 into which fasteners may be inserted for attaching hinges 14 or trusses 17 or the like.

The groove 46A includes a front panel face 72 connected by an arcuate section 74 to an upwardly extending, inwardly inclined wall 76. A generally horizontal wall 78 in outside panel member 40 includes a recess 80 for a seal member 86. The wall 78 then connects with an upwardly extending flange 82 that is in opposed relationship to an upwardly extending flange 85 of the inside panel member 42. The inside panel member 42 then includes a connecting wall 87 which is arcuate and compatibly shaped with respect to the depending arcuate section 66 of the tongue 44A. Importantly, a projecting hook 77 formed on the inside panel member 42 rests on a barrel or knuckle 105 of hinge members 100, 102. This is described in greater detail hereinafter.

The various described walls and planar sections of the tongue 44A subtend those of the groove 46A so that, as depicted in FIG. 3, there is a slight spacing therebetween. Additionally, first seal member 84 and second seal member 86, each of which are associated with the outside panel member 40 inasmuch as each is situated in recesses 54, 80 defined in the outside member 40, facilitate a seal between the panels 12 when in the position illustrated in FIG. 3. Further, the inside panel member 42 is joined to the outside panel member 40 by an adhesive and sealant material 61 which is positioned between the flanges 60, 62 defined between the inside panel member 42 and outside panel member 40. The combination of the seals 84, 86 plus the insulating adhesive 61 in further combination with the insulating material 45 within the space between the panel members 40 and 42 provides a means to insulate and thus control the environment within a building utilizing such a described door by preventing heat loss, for example.

The panels 12 arrayed as depicted in FIG. 4 are maintained in such array by means of hinge members 14. Thus, an upper hinge leaf 100 cooperates with a lower hinge leaf 102. Upper hinge leaf 100 is affixed by fasteners 104 to the inside panel member 42 and a reinforcing strip 70 on the inside of the inside panel member 42. Lower hinge leaf 102 is maintained by fasteners 108 which extend through the inside panel member 42 as well as a reinforcing strip 103 into the region between panel members 40, 42 in the vicinity of the tongue 44A of the panel 12. The hinge leaves 100 and 102 are joined by a pin or pintle 110 which fits through the barrel 105 of the respective hinge leaves 102 and 104. Importantly, the hook section 77 of the groove 46A associated with the panel member 44 fits on top of and against the barrel 105 of the hinge leaves 102 and 100. This support is provided substantially during the entire articulation movement of the panels with respect to one another as depicted in FIGS. 3 and 4. The point or arcuate projection 74 of the groove 46A rests on the shelf 50 when the panels 12 are in the position illustrated in FIG. 3. Thus, there is two point support of the panels 12 one above the other when in the configuration illustrated in FIG. 3. It is to be noted that with the panel member 42 configuration depicted, the foam insulating material 45 in the region between the inside panel member 42 and the outside panel member or sheet 40 more completely fills the region associated with the tongue and groove connection thus providing enhanced insulating characteristics. That is, the finger projection or hook 77 provides a region into which insulating foam 45 material may be filled.

Figure 5:
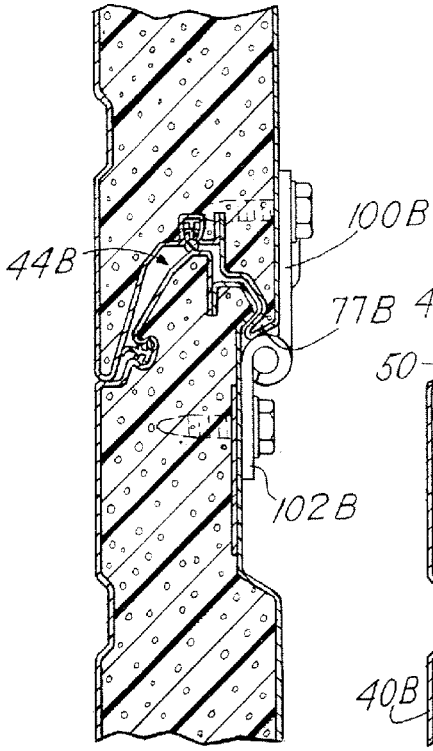
FIG. 5 is a side, cross sectional view of first and second door panels incorporating the features of the invention wherein the door panels are comprised of, an outside panel member and an inside panel member which are spaced a greater distance than the spacing of the embodiment of FIGS. 3 and 4 and wherein the panels are arrayed in a flat planar fashion.
Figure 6:
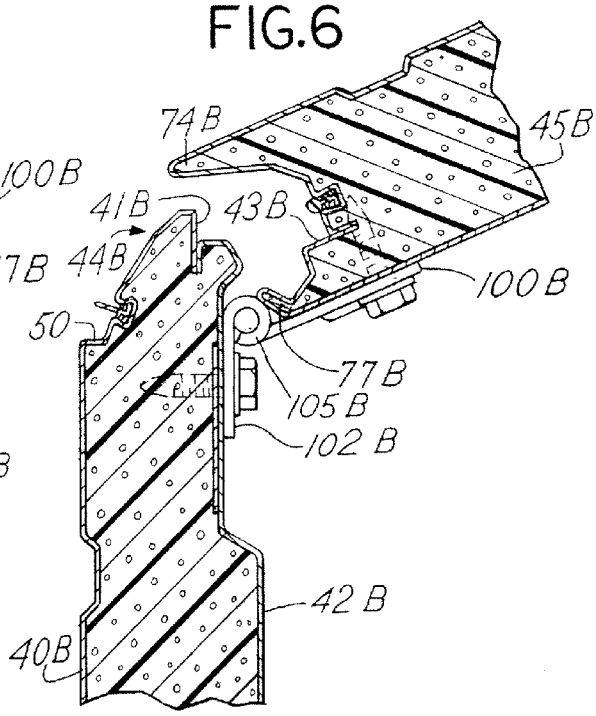
FIG. 6 is a cross sectional view illustrating the panel of FIG. 5 in an articulated position.

FIGS. 5 and 6 set forth an embodiment wherein the various parts of the panel members 40, 42 are labeled with the subscript B and wherein the description with respect to FIGS. 3 and 4 applies substantially as set forth by utilizing the subscript B with respect to the description. The differences relate to the construction near the adhesive joint between the respective inside panel member 42B and outside panel member 40B. That is, the configuration of the tongue 44B includes an elongated vertical wall section 41B that is compatible with an elongated vertical wall section 43B. This arrangement provides a further circuitous pathway to prevent airflow in the region between the panels 12 when the panels 12 are in the position depicted in FIG. 5. Thus, this arrangement enhances the insulating characteristics of the construction. Note, however, that the finger section 77B rests on the barrel 105B of the hinge. Further, it is to be noted that the panels 12 in their flat panel array as illustrated in FIG. 5 provide for support via the engagement of the groove projection 77 at the front section of the panels 12 as well as the rear section 74B on the barrel 105B of the hinge.

Figure 8:
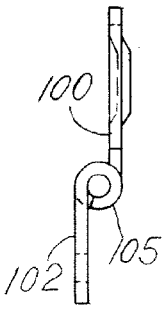
Figure 7:
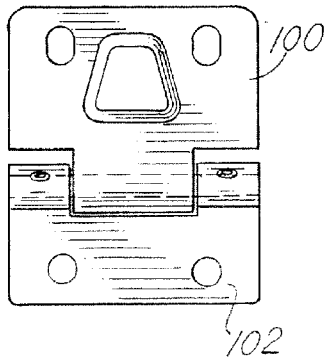
Figure 10:
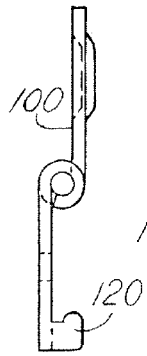
Figure 9:
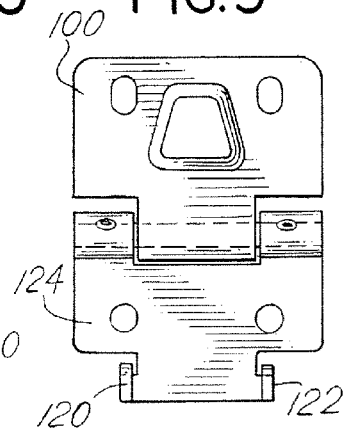

FIGS. 7 and 8 comprise, respectively, a plan view and a side view of a hinge 14 which may be utilized to connect panels 12. FIGS. 9 and 10 illustrate a further hinge embodiment which includes first and second spaced outwardly projecting support arms 120, 122 on leaf 124 for cooperation with support of a truss member 17. A truss member 17 comprises a horizontal beam which extends generally across the width of the panel 12 to provide enhanced rigidity to the panel 12. FIG. 11 (a plan view), FIG. 12 (a side view of FIG. 11), and FIG. 12A (a sectional view of FIG. 11) depict a truss hinge including upper leaf 126, lower leaf 128 and inclined brace 130 with a shelf support 131. thus, a bolt or fastener may be fitted through an opening in shelf support 131 to attached to a cross brace 17, for example. FIGS. 13, 14, and 14A illustrate yet another configuration wherein a lower leaf 130A includes a shelf section 132 which provides support and cooperation with, for example, a support bracket for rollers 15 or a brace 17. The shelf 132 thus includes openings for receipt of fasteners such as opening 134.

Figure 16:
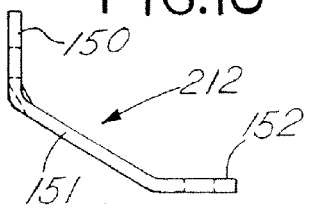
FIGS. 15, 15A and 16 comprise views illustrating a truss bracket used in the practice of the invention.
Figure 15:
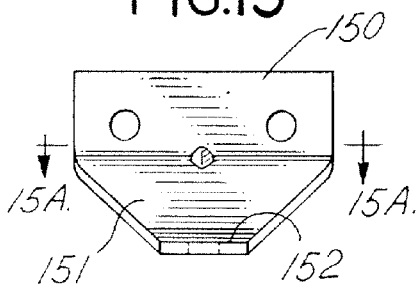
Figure 15A:
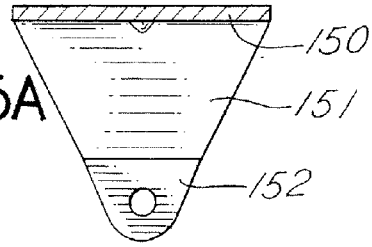

FIGS. 15, 15A and 16 depict braces 212 which accommodate various design requirements associated with the door construction, for example, as described with respect to FIG. 22 or FIG. 23. Brace 212 includes a plate or run 150, an inclined section 151 and an attachment section transverse to run 150.

Figure 17:
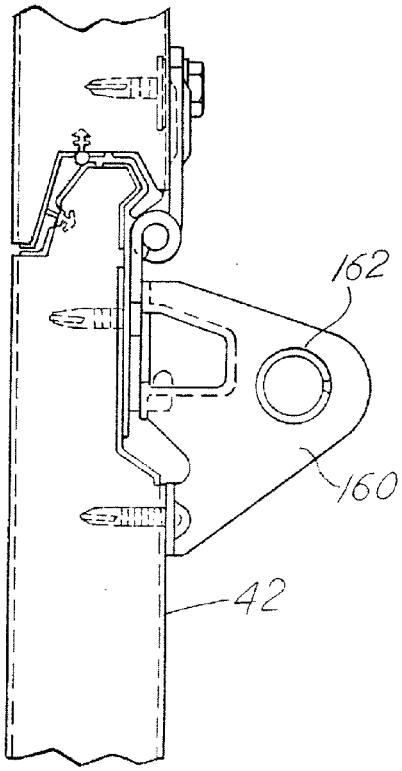
FIGS. 17 and 18 are side views of a combination of panels with various hinge configurations and truss or roller brackets.
Figure 18:
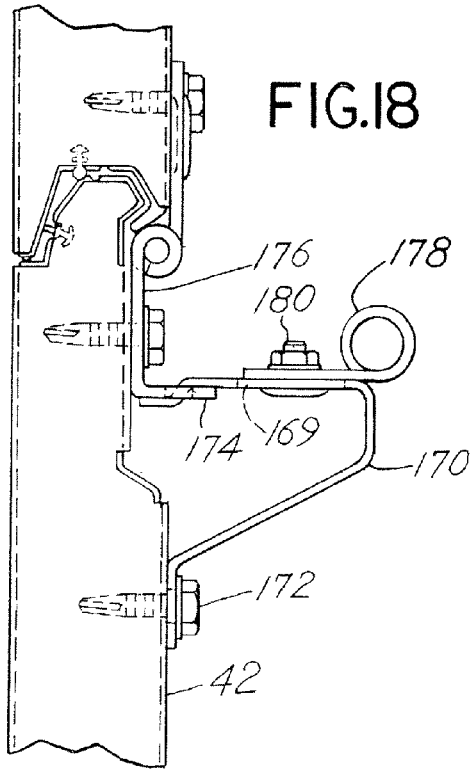

FIG. 17 is a side view illustrating a typical hinge leaf in combination with a roller bracket 160 having an opening 162 for receipt of the spindle or axel of a roller 15 that fits in a track 20 of a door construction. The roller bracket 160 is of a fixed size and configuration and is attached by fasteners to the inside panel member 42 of the door panel. FIG. 18 illustrates a hinge construction of the type depicted generally in FIGS. 13 and 14 in combination with a roller bracket 178 which is generally adjustable. That is, a roller brace 170 is affixed to the inside panel member 42 by a fastener 172 and by connection with the shelf 174 of the leaf 176.

A slot 169 (in phantom) in the bracket 170 permits sliding adjustment of a roller bracket 178 as indicated by the arrow. That is, the fastener 180 may be tightened to fix the position of the roller bracket 178.

Figure 19:
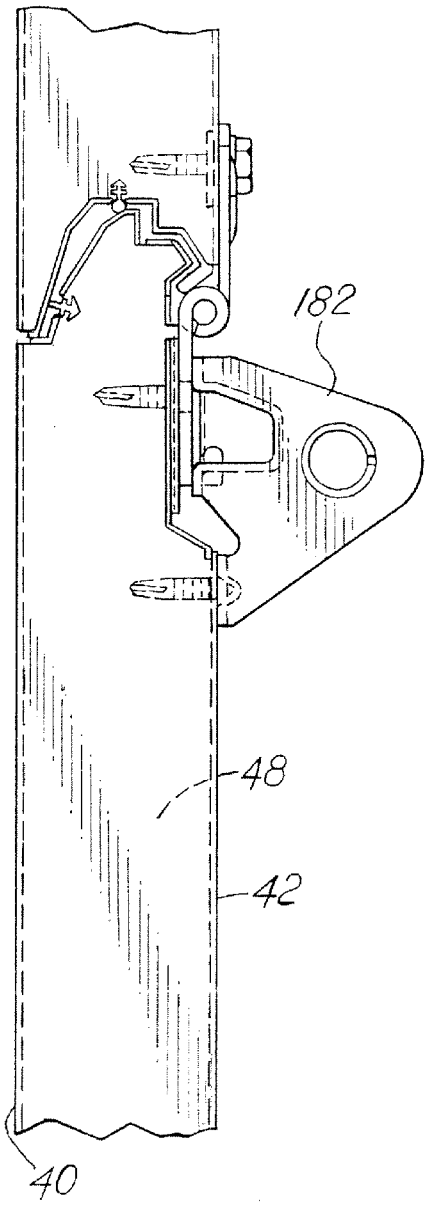
FIGS. 19 and 20 are additional side views of panels illustrating the combination of various roller brackets in combination with hinge members as attached to door panels.

FIG. 19 depicts a fixed, non-adjustable roller 182 bracket of the type shown in FIG. 17 in combination with a door panel 12 having a thickness greater than the door panel depicted in FIG. 17.

Figure 20:
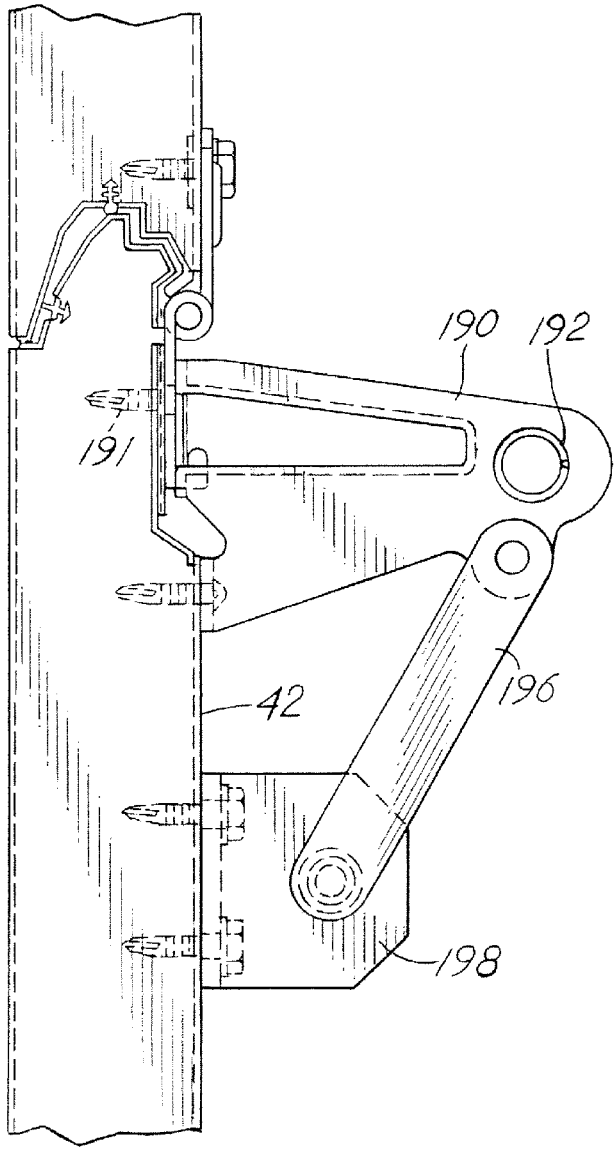

FIG. 20 illustrates another construction for the combination of a roller bracket 190 with a door panel. Roller brackets 190 having a variety of spacing from the inside panel member 42 are or may be selected to provide an opening for receipt of the axel of a roller 15. Thus, axel opening 192 is custom spaced from the door panel member 42 depending upon the size of bracket 190 chosen. The choice of the size of the bracket 190 provides for a variance in the distance of the opening 192 from a panel 12. The bracket 190 is thus attached by fasteners 191 to the hinge leaf of the type depicted in greater detail, for example, in FIGS. 9 and 10. The bracket 190 thus cooperates with such a hinge leaf. Because the outward extension of the bracket 190 may be varied depending upon the choice of the size of the bracket 190, a universal brace support 196 may be used to augment support of the bracket 190. An attachment plate 198 associated with the brace 196 may thus be engaged at a desired location with the inside panel 42 so that the brace 196 will appropriately support the roller bracket 190. That is, the brace 196 is pivotal with respect to the bracket attachment plate 198 so that the bracket attachment plate 198 may be positioned appropriately to provide adequate support for the roller bracket 190.

FIG. 21 illustrates the construction of a top roller bracket for a top panel in an array of panels. A brace member 200 supports a slidably adjustable connected roller bracket 202 mounted on a bracket member 204 which is attached to the brace 200. In the configuration shown in FIG. 21, a weather seal 206 is attached by fastener 208 to the tongue 210 at the top of the panel 12 to seal the top of panel 209 against a frame for an opening when the door panels are closed.

Referring to FIG. 22, a truss bracket, as depicted in FIGS. 15 and 16, is utilized to cooperate with a truss 211. The truss extends typically horizontal across the width of a panel 12.

Brackets, such as brackets 212, are positioned intermittently across the backside of panel member 42 to support the truss 210.

FIG. 23 illustrates another embodiment of the utilization of the truss 211 supported by the bracket 212 in combination with a panel of the type shown in FIGS. 5 and 6 which has a thickness greater than the panel shown in FIGS. 3 and 4. Thus, FIG. 23 is associated with the panel of FIGS. 5 and 6. FIG. 22 is associated with the panel 12 of FIGS. 3 and 4.

Figure 24:
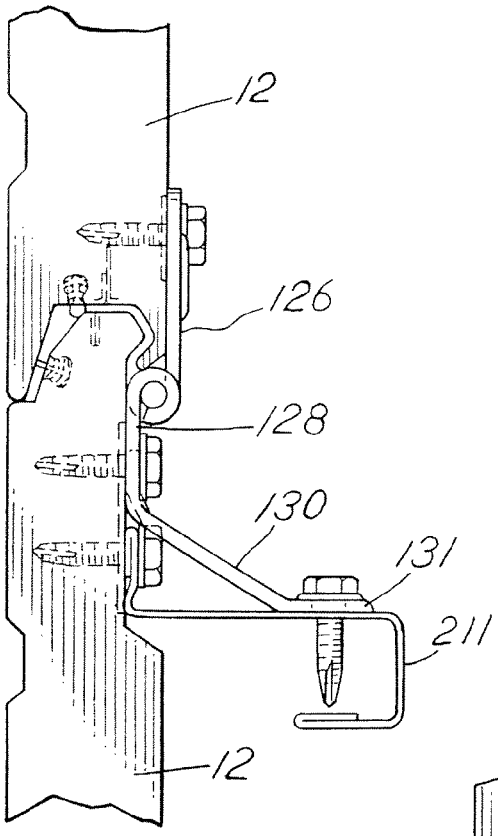
FIGS. 24-26 are side views that illustrate the combination of various hinge members with and without truss support members.
Figure 25:
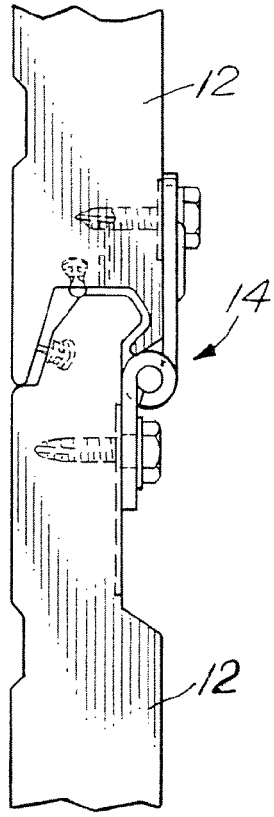
Figure 26:
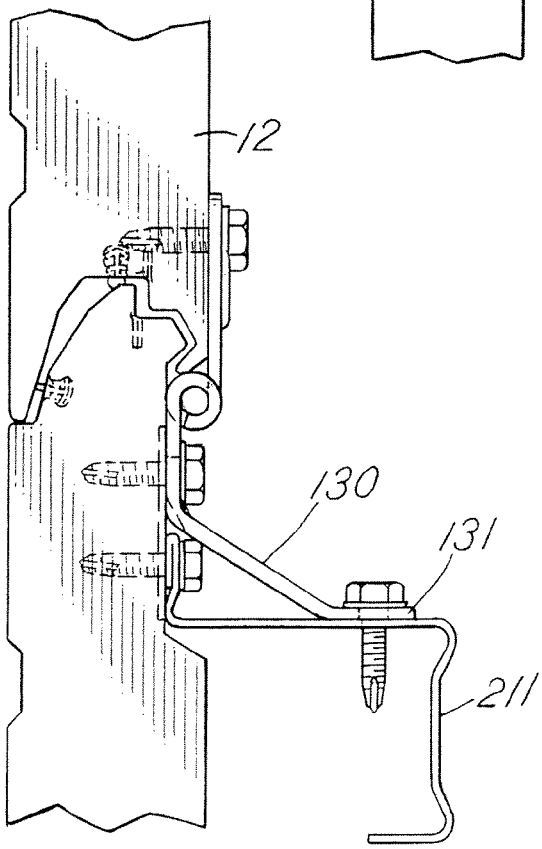

FIG. 24 is a further illustration of the combination of the truss 211 with a truss hinge as depicted, for example, in FIG. 11 or 12. FIG. 25 depicts a hinge 14 in association with stacked panel members wherein the hinge 14 has the construction of FIGS. 7 and 8. FIG. 26 is very similar to FIG. 24 in that it depicts the utilization of the truss hinge of the type depicted in FIGS. 11 and 12 in combination with a truss 211 wherein the elements are combined in combination with panels 12 having a thickness and design as depicted in 5 and 6.

Figure 27:
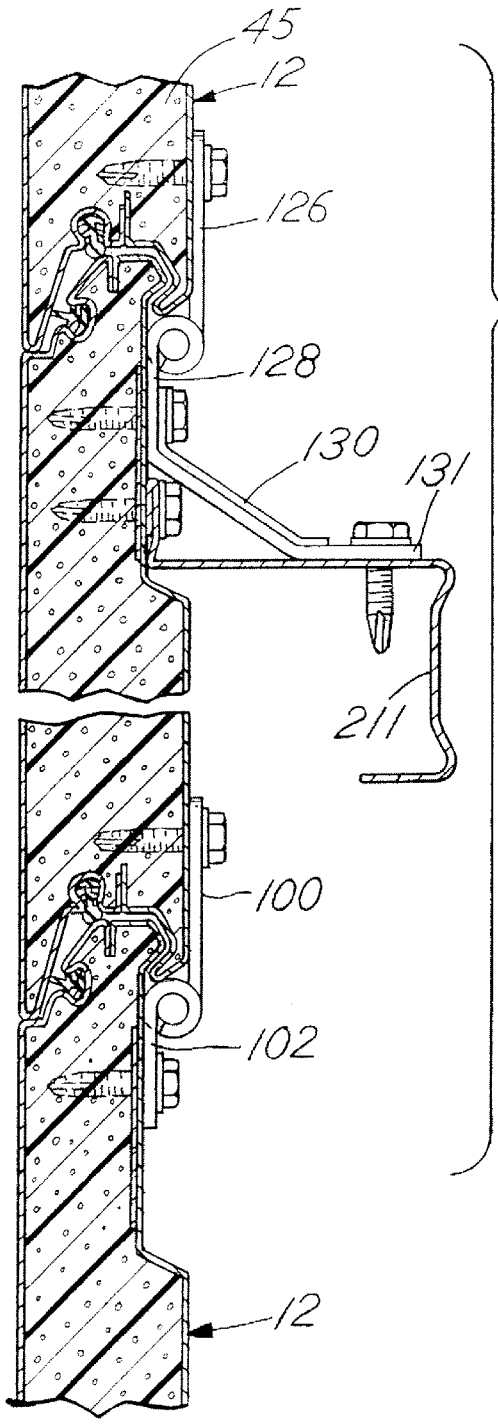
FIG. 27 is a side view which illustrates the utilization of hinge members in combination with truss supports as incorporated with multiple door panels in a door panel array.
Figure 27A:
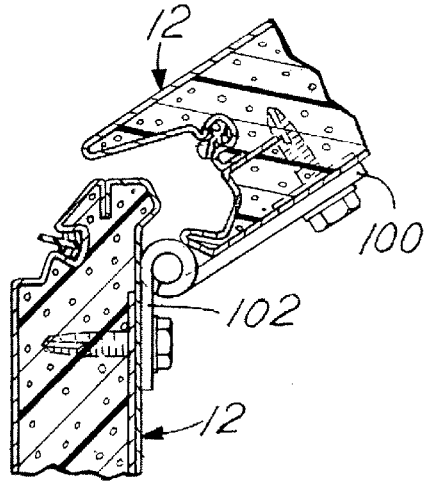
FIG. 27A is an enlarged sectional view of the panels of FIG. 27 articulated.

FIGS. 27 and 27A depict three panels 12 connected together by means of the various hinge and truss constructions previously described wherein the panels 12 are of a construction depicted in FIGS. 3 and 4.

Figure 28:
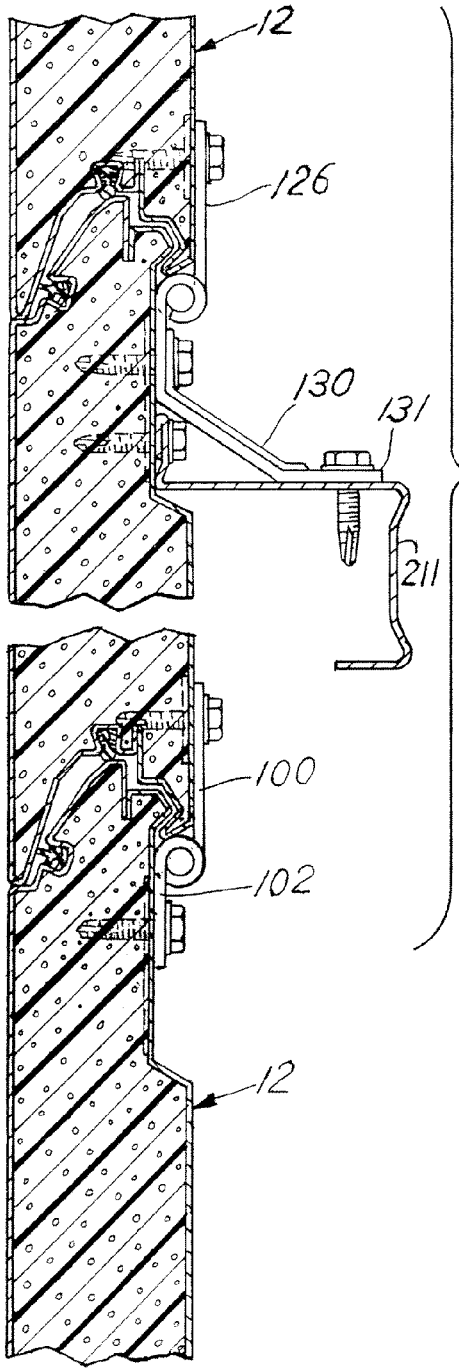
FIG. 28 is a side view similar to FIG. 27 wherein the hinge members and truss support members are utilized in combination with a door panel having a lateral dimension or thickness greater than the embodiment of FIG. 27.
Figure 28A:
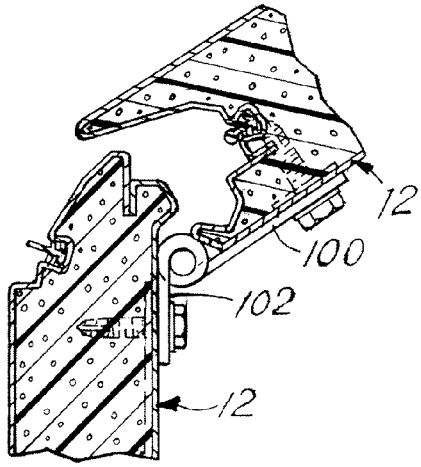
FIG. 28A is an enlarged sectional view of the panels of FIG. 28 articulated.

FIGS. 28 and 28A depict the combination of truss construction 211 and hinges 14 for three panels 12 wherein the panels are of a thickness and configuration as depicted in FIGS. 5 and 6.

Figure 29:
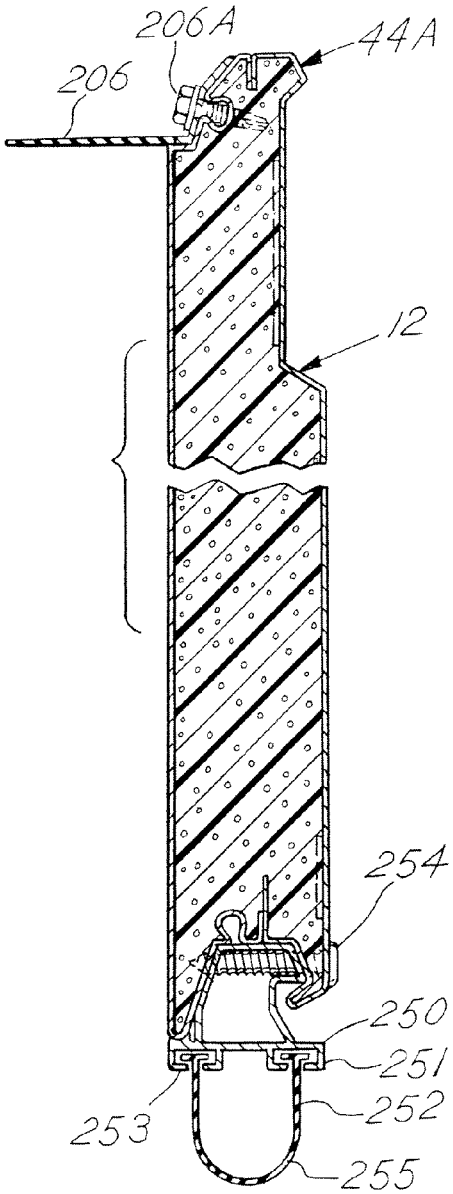
FIG. 29 is a side, cross sectional view of the truss panel construction of FIG. 27 incorporating edge members at the lower and upper edge or side of an array of door panels.

FIG. 29 is a depiction of a panel 12 construction of a type depicted in FIGS. 3 and 4 depicting in greater detail the upper weather seal 206 attachment at the upper end of the top panel 12 and the lower bottom seal arrangement at the bottom end of the bottom panel 12. The top seal 206 is attached by means of a fastener 206A as previously described. The bottom seal incorporates an extruded member 250 which includes a flexible weather seal 252. The extruded member 250 has a cross section as depicted and is attached by means of a fastener 254.

Figure 30:
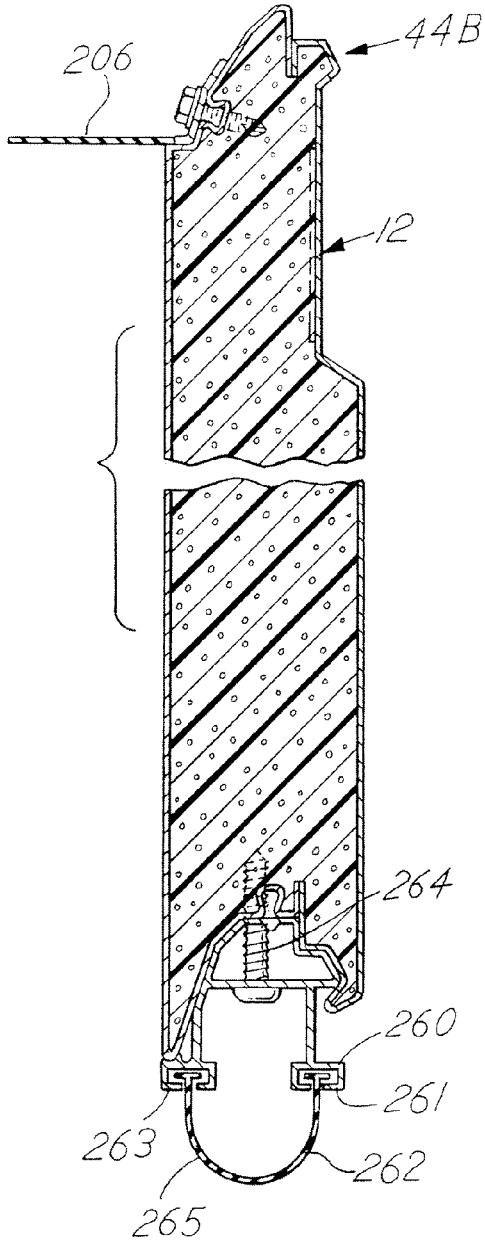
FIG. 30 is a side, cross sectional view of the panel construction of FIG. 28 illustrating the configuration of the lowermost and uppermost door panel in an array of door panels.

With respect to the top and bottom weather seal arrangement associated with panels as set forth in FIGS. 5 and 6 reference is directed to FIG. 30. There the top weather seal 206 is attached by means of a fastener as depicted. Along bottom edge of bottom panel 12, extrusion 260 cooperates with a flexible weather seal 262. A fastener 264 retains the sealing arrangement along the bottom edge of the bottom panel of the array. In the embodiments of FIGS. 29 and 30 the cross sectional configuration of the extrusion (250 or 260) includes an upper section shaped to conform with the groove configuration of the associated panel and a lower section comprised of two parallel, spaced channels 251, 253 or 261, 263 for receipt of flanged flexible seals 255, 265.

While there has been set forth various embodiments of the invention, the invention is to be limited only by the following claims and equivalents thereof.

What is claimed is:

1. A multiple panel, garage door construction comprising:

a generally rectangular first panel;

a generally rectangular second panel, said first panel and said second panel each including a first, outer, panel sheet and a second, inner, panel sheet spaced from the first panel sheet;

said first and second sheets of the first panel and of the second panel each including a generally straight first edge and a generally straight opposite side second edge, said first and second panel sheets of said respective first and second panels being generally congruent, said first panel having said first side edge with a first cross-sectional configuration, said second panel having said second side edge with a second cross-sectional configuration aligned in opposed relation to the first side edge of the first panel, said second cross-sectional configuration generally complimentary with said first panel first cross-sectional configuration to provide a generally pinch proof, sealed joint upon generally flat planar alignment of said first panel and said second panel effected by closing of an array of said first panel with said second panel;

said first cross-sectional configuration of said first side edge of the first panel including:

a front, generally planar face of said first outer panel sheet, an inwardly, generally transverse shelf of said first outer panel sheet, an upwardly and inwardly inclined wall of said first outer panel sheet with an extending end, said inclined wall connected at the extending end thereof to said second inner panel sheet of said first panel solely by an adhesive material joint;

said second cross-sectional configuration of said second panel edge including:

a front, generally planar face of said first outer panel sheet connected by a support edge of said first outer panel sheet to an upwardly and inwardly inclined wall of said first outer panel sheet connected to a generally inwardly extending wall, said inwardly extending wall adhered to the second inner panel sheet of said second panel solely by an adhesive material joint, said first side edge of said first panel configured to subtend the opposed second side edge of said second panel in the panel array closed position with said support edge of said second side edge generally supported solely on said transverse shelf of said first side edge, said first side edge panel sheets and said second side edge panel sheets otherwise not contacting one another and said respective inclined walls subtending each other;

said first side edge defining a generally tongue configuration compatible with a generally groove configuration of said second side edge in combination providing a pinch proof panel joint; and at least a first sealing member and a second sealing member positioned respectively in the inclined wall of said first outer panel sheet of said first side edge and the inclined wall of said first outer panel sheet of said second side edge in opposed and unaligned relation to effect sealing of said panels in between said inclined walls when said panels are aligned generally horizontally by engagement of each seal with an opposed inclined wall.

2. The construction of claim 1 including insulating material intermediate the first outer panel sheet and the second inner panel sheet.

3. The construction of claim 1 further including a feature selected from the group consisting of:

a) a reinforcing strip of material extending across at least a part of the inner panel sheet for attachment by fasteners to the inner panel sheet;

b) at least one hinge including a first hinge leaf having a barrel connected to one panel on the inner panel sheet and a second hinge leaf having a barrel attached to an adjacent panel on the adjacent inner panel sheet, a pin connecting barrels of the hinge leafs and a truss element attached to one of said hinge leafs;

c) universal sized and configured hinges connecting adjacent panel members and further including hinges with roller supports;

d) an adjustable roller support attached to a hinge leaf wherein the roller support is affixed to a bracket and slidably adjustable; and e) a hinge having a shaped leaf with a projecting attachment shelf and further including a bracket connected to said attachment shelf.

4. The construction of claim 1 further including a hinge leaf mounted on the inner sheet of one of said panels and having a projecting support shelf, a bracket attached to the shelf, and an adjustable roller support attached to the bracket.

5. The construction of claim 1 further including a hinge leaf mounted on one of said panels with a support bracket attached to said leaf and a cross brace attached to the support bracket.

6. The construction of claim 1 further including a hinge leaf mounted on one of said panel, a cross member brace positioned against said inner sheet of said panel aligned with said hinge leaf, and a fastener for attaching the hinge leaf to the inner sheet and cross member brace.

7. The construction of claim 1 including connected first and second hinge leafs attached respectively to the first and second panels wherein one of said hinge leafs includes a projecting shelf extending from the inner sheet and a cross brace member attached to said projecting shelf to reinforce the panel.

8. The construction of claim 1 including foam insulating material intermediate the first outer panel sheet and the inner second panel sheet.

9. The construction as set forth in claim 1 further comprising:

a first hinge leaf affixed to the inner panel sheet adjacent said panel joint;

a second hinge leaf affixed to the inner panel sheet of the next adjacent panel at said panel joint;

said first and second hinge leafs each having a hinge barrel and joined by a pintle;

said inner panel sheet of said second side edge including, in said second cross-sectional configuration an inside finger support element for engaging the hinge barrel for support.

* * * * *